US006295898B1

(12) United States Patent
Hsieh

(10) Patent No.: US 6,295,898 B1
(45) Date of Patent: Oct. 2, 2001

(54) ANGLE-ADJUSTABLE WRENCH

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/551,491

(22) Filed: Apr. 18, 2000

(51) Int. Cl.[7] ..... B25B 23/16
(52) U.S. Cl. ..... 81/177.8
(58) Field of Search ..... 81/177.8, 177.9

(56) References Cited

U.S. PATENT DOCUMENTS 4,463,632 * 8/1984 Parke ..... 81/177.9
4,901,608 * 2/1990 Shieh ..... 81/177.8
5,199,335 * 4/1993 Arnold et al. ..... 81/177.8
5,820,288 * 10/1998 Cole ..... 403/97
5,943,925 * 8/1999 Huang ..... 81/177.2
6,000,299 * 12/1999 Cole ..... 81/60
6,000,302 * 12/1999 Chiang ..... 81/177.8
6,148,698 * 11/2000 Hsieh ..... 81/177.8

* cited by examiner

*Primary Examiner*—Joseph J. Hail, III
*Assistant Examiner*—David B. Thomas

(57) ABSTRACT

An angle-adjustable wrench includes a handle having a front end and two parallel lugs forwardly extended from the front end, a pivot connected between the lugs of the handle, and a wrench head turned about the pivot within 180° relative to the handle, wherein the wrench head has a retaining area and an adjustment area arranged in parallel and facing the front end of the handle between the lugs, and a stop member is coupled to the handle and moved along the front end of the handle between the lugs between a first position where the stop member is engaged with an arc-like, recessed, toothed portion thereof with the retaining area to lock the wrench head, and a second position where the stop member is disposed in contact with the adjustment area for enabling the wrench head to be turned about the pivot relative to the handle.

4 Claims, 8 Drawing Sheets

ANGLE-ADJUSTABLE WRENCH

BACKGROUND AND SUMMARY OF THE INVENTION

The present invention relates to a wrench, and more specifically to a durable angle-adjustable wrench, which comprises a pivoted wrench head that can conveniently be adjusted to the desired angle within 180° relative to the handle.

A variety of wrenches, including combination wrenches, hex wrenches, ratchet wrenches, ratchet socket wrenches, etc. have been disclosed, and have appeared on the market. According to conventional wrenches, the angular position of the wrench head is not adjustable. FIGS. 1 through 3 show a wrench in which the angular position of the wrench head can be adjusted within 180° relative to the handle. The wrench head has a coupling block pivoted to the handle. The coupling block has teeth. The handle has spring-supported steel balls engaged with the teeth at the coupling block of the wrench head. Because the wrench head is held in position by means of the engaging force between the spring-supported steel balls and the teeth at the coupling block, the wrench head tends to be forced out of the fixed angular position. Further, frequently turning the wrench head relative to the handle causes the teeth to wear quickly.

The present invention provides an angle-adjustable wrench, which eliminates the aforesaid drawbacks. According to the present invention, a stop member is movably provided between the handle and the wrench head, and shifted between the locking position where the wrench head is locked, and the unlocking position where the wrench head is unlocked and can be adjusted to the desired angle relative to the handle. The wrench head has a retaining area and an adjustment area facing the handle and arranged in parallel. The stop member has a recessed, toothed portion. The toothed portio of the stop member is forced into engagement with the retaining area to lock the wrench head when the stop member is moved to the locking position, or disposed in contact with the adjustment area for enabling the wrench head to be turned relative to the handle when the stop member is moved to the unlocking position.

DETAILED DESCRIPTION OF THE PREFERRED EMBODIMENT

Figure 1:
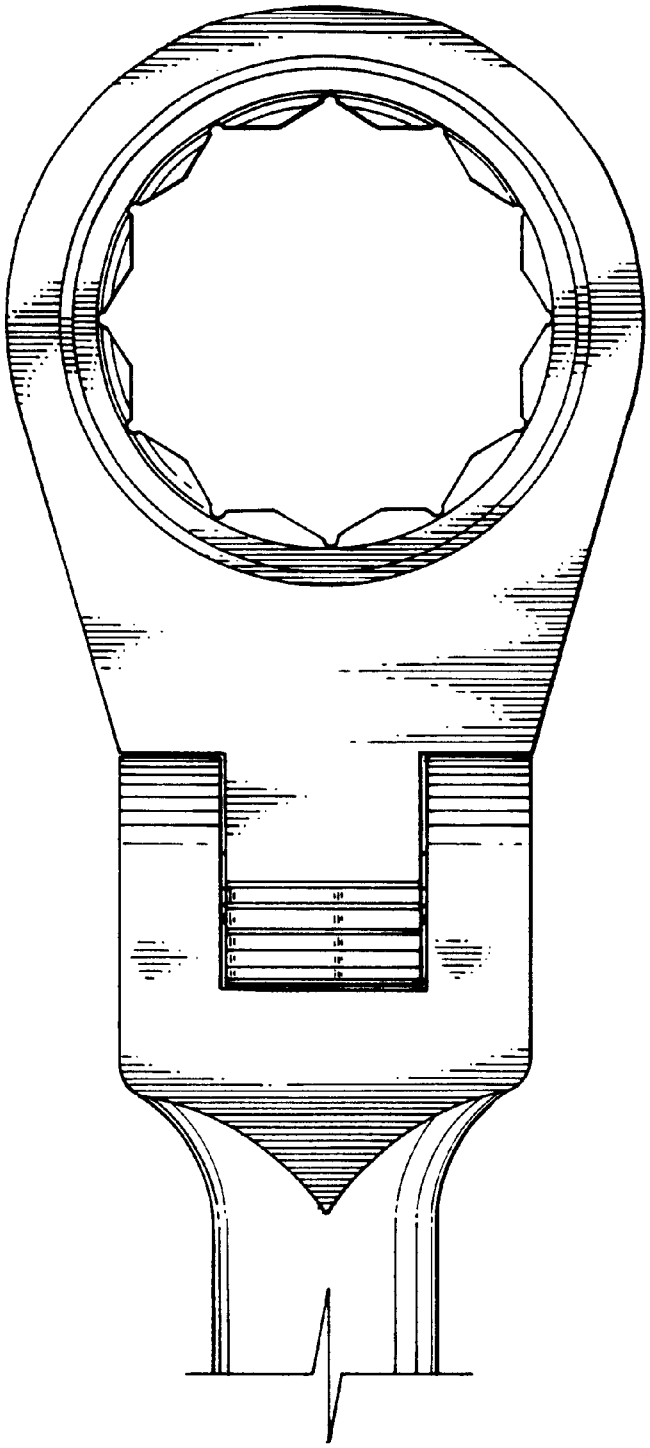
Fig . 1 PRIOR ART
FIG. 1 is a front view of an angle-adjustable wrench according to the prior art.
Figure 2:
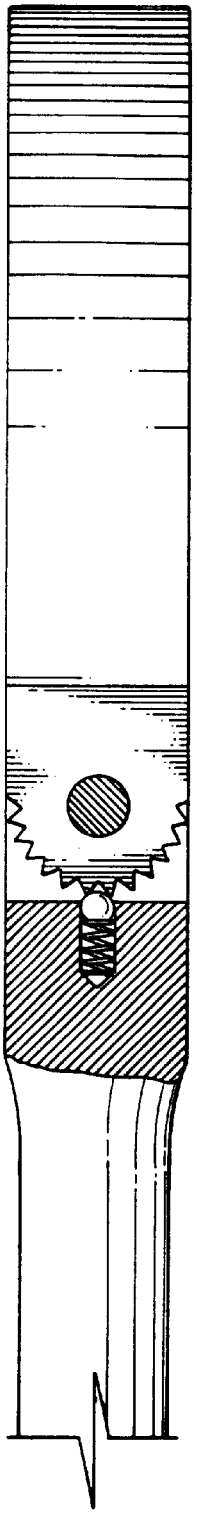
Fig. 2 PRIOR ART
FIG. 2 is a side view in section of the angle-adjustable wrench shown in FIG. 1.
Figure 3:
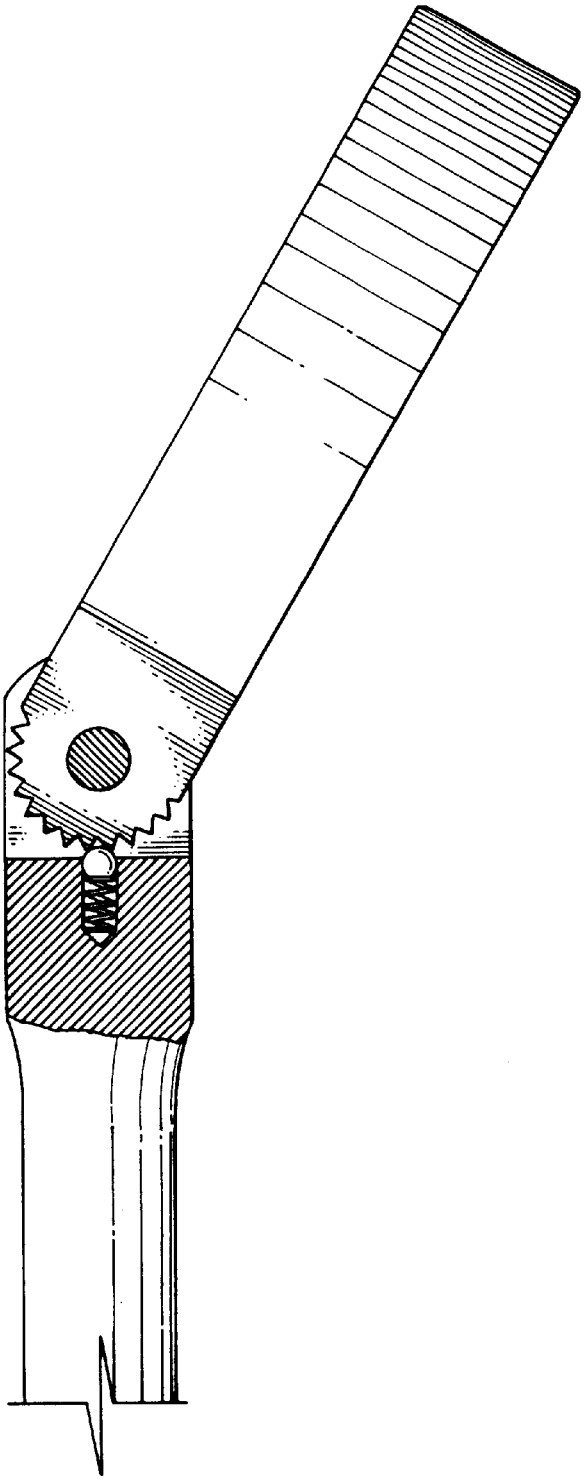
Fig. 3 PRIOR ART
FIG. 3 is similar to FIG. 2 but showing the angle of the wrench head adjusted.
Figure 4:
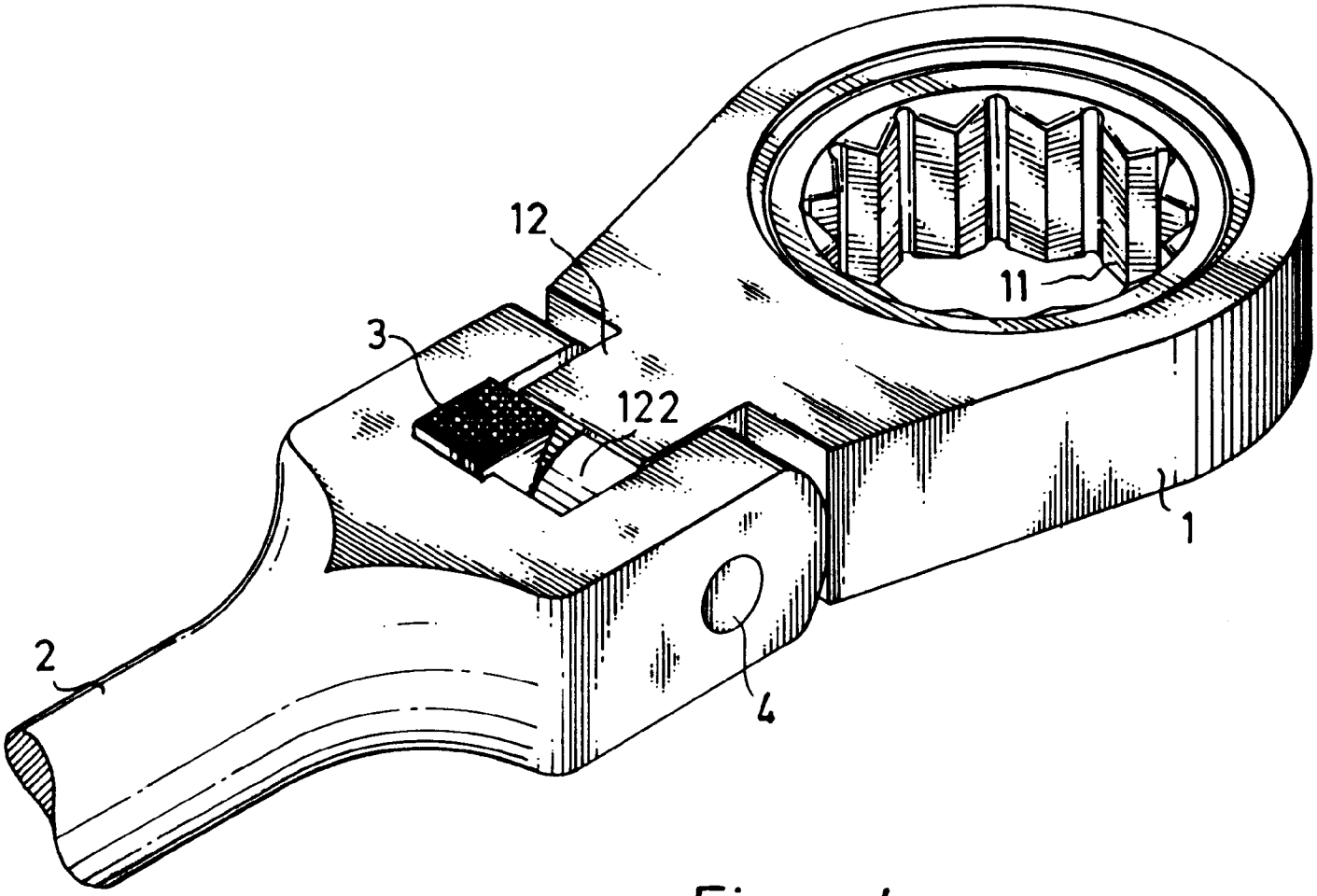
FIG. 4 is an elevational view of an angle-adjustable wrench according to the present invention.
Figure 5:
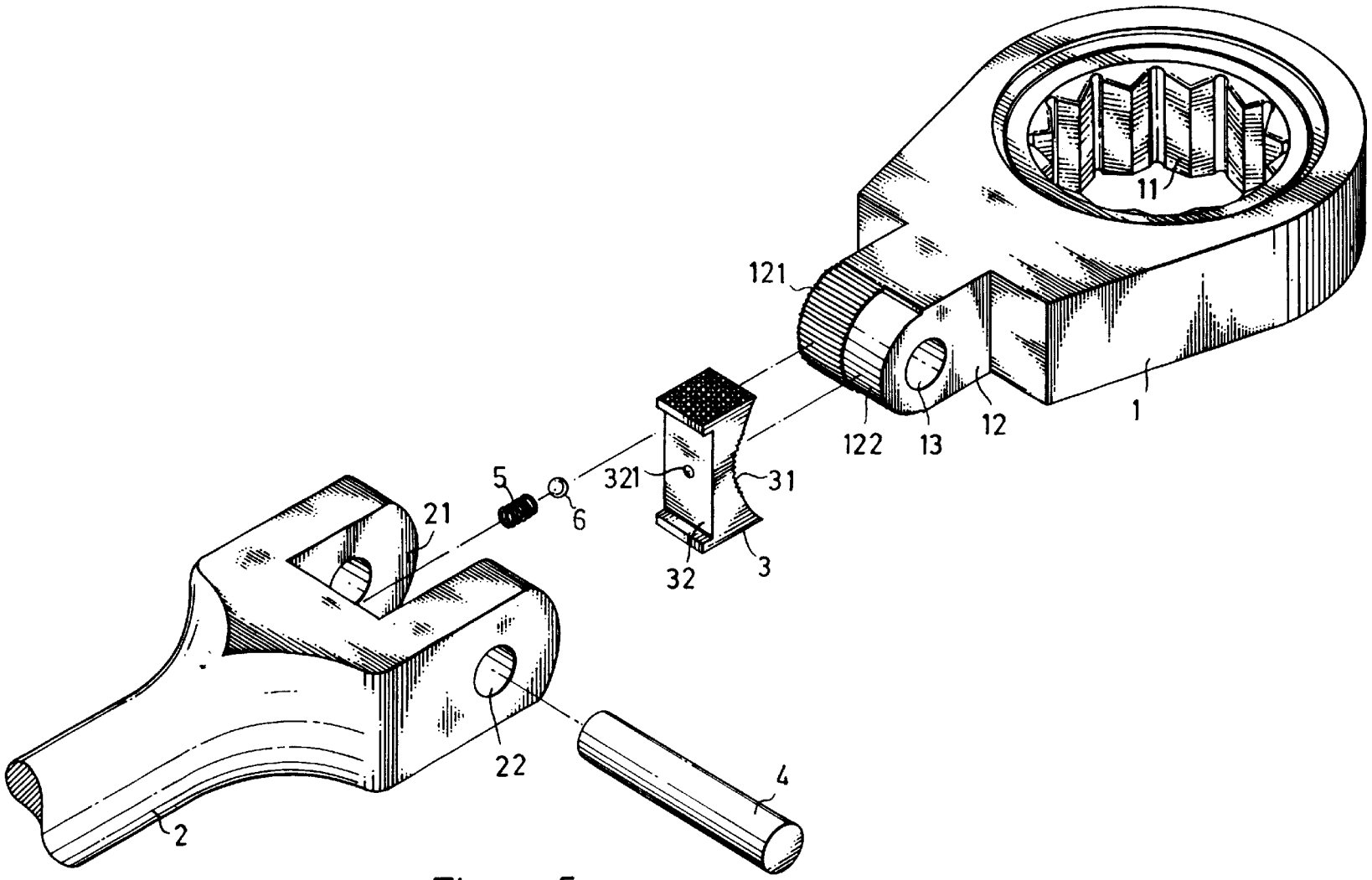
FIG. 5 is an exploded view of the angle-adjustable wrench shown in FIG. 4.

Referring to FIGS. 4 and 5, an angle-adjustable wrench in accorance with the present invention is generally comprised of a wrench head 1, a handle 2, and a stop member 3. The wrench head 1 is a box-end member having a box 11 in it and a coupling block 12 at its one end. The coupling block 12 comprises a transversely extended pivot hole 13, a retaining area, namely, the smoothly arched smooth surface portion 122, and an adjustment area, namely, the arched, toothed surface portion 121. The smoothly arched smooth surface portion 122 and the arched toothed surface portion 121 are arranged in parallel around the periphery of the pivot hole 13. The handle 2 comprises a blind hole 211 on the front end thereof, and two lugs 21 bilaterally forwardly extended from the front end. The lugs 21 each have a pivot hole 22. A pivot 4 is mounted in the pivot hole 22 on each lug 21 of the handle 2 and the pivot hole 13 on the coupling block 12 of the wrench head 1 to secure the wrench head 1 to the handle 2, enabling the wrench head 1 to be turned about the pivot 4 within 180° relative to the handle 2. A spring element 5 is mounted in the blind hole 211 on the handle 2. A steel ball 6 is supported on the spring member 5, and partially projecting out of the blind hole 211. The stop member 3 is disposed between the wrench head 1 and the handle 2, comprising an arc-like, recessed, toothed portion 31 disposed at the front side thereof for engagement with the smoothly arched toothed surface portion 121 of the coupling block 12, a positioning portion 32 disposed at the back side thereof and coupled to the front end of the handle 2 between the lugs 21, and a locating hole 321 disposed in the positioning portion 32 for engagement with the steel ball 6.

Figure 6:
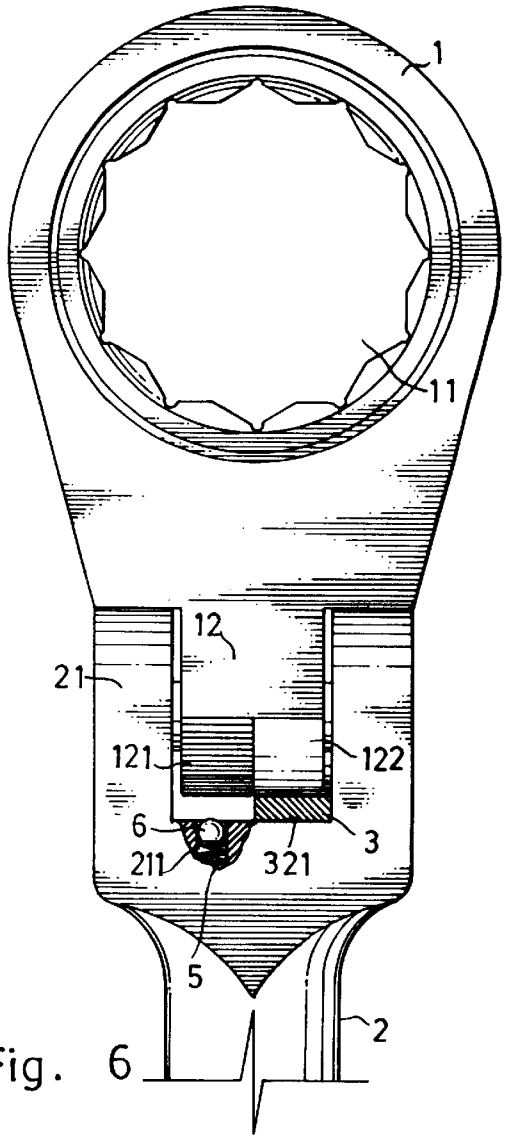
FIG. 6 is a front view of the present invention, showing the stop member moved to the unlocking position and disposed in contact with the adjustment area of the wrench head.
Figure 7:
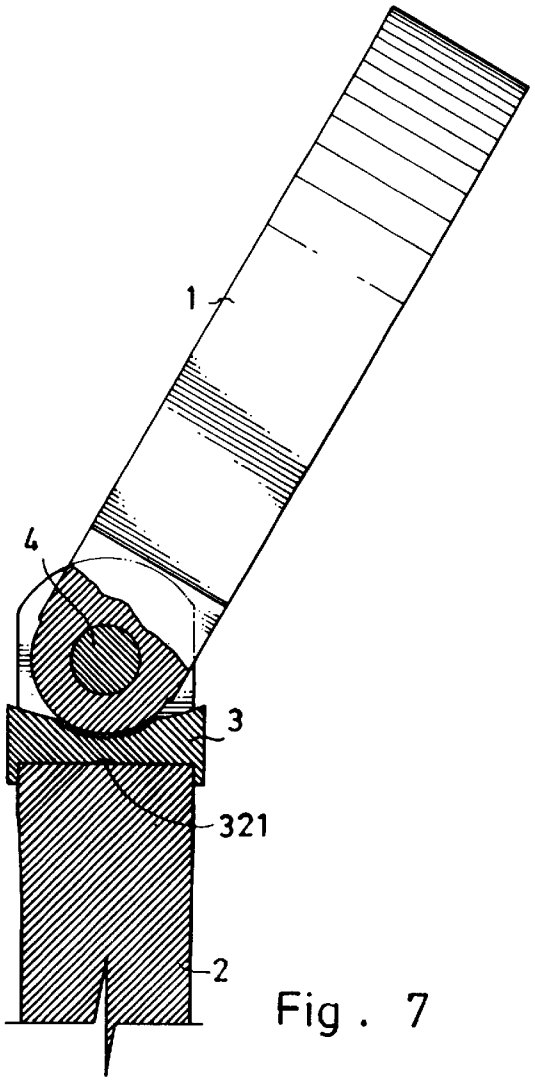
FIG. 7 is a side view of the present invention, showing the angular position of the wrench head adjusted.
Figure 8:
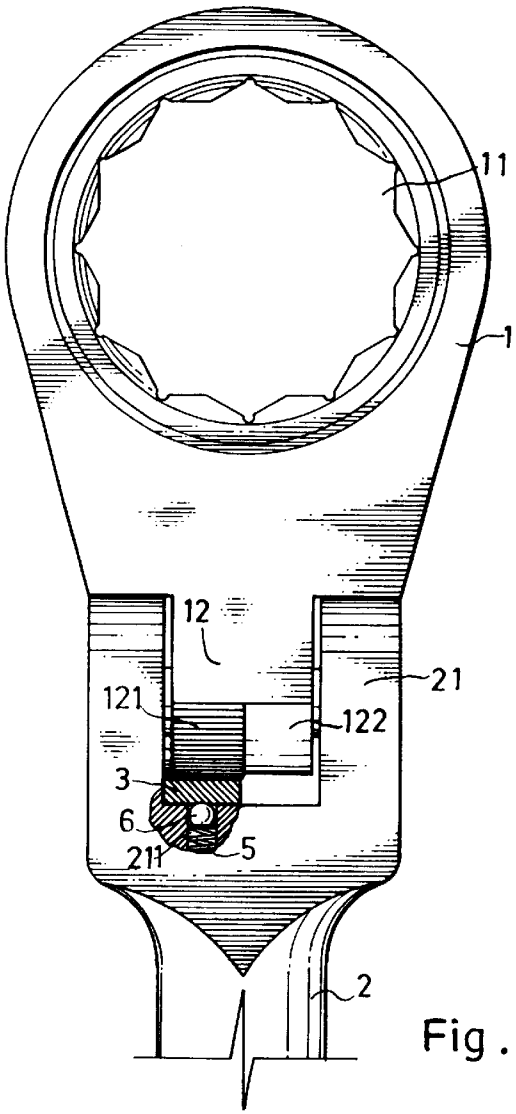
FIG. 8 is similar to FIG. 6 but showing the stop member moved to the locking position and engaged with the retaining area of the wrench head.
Figure 9:
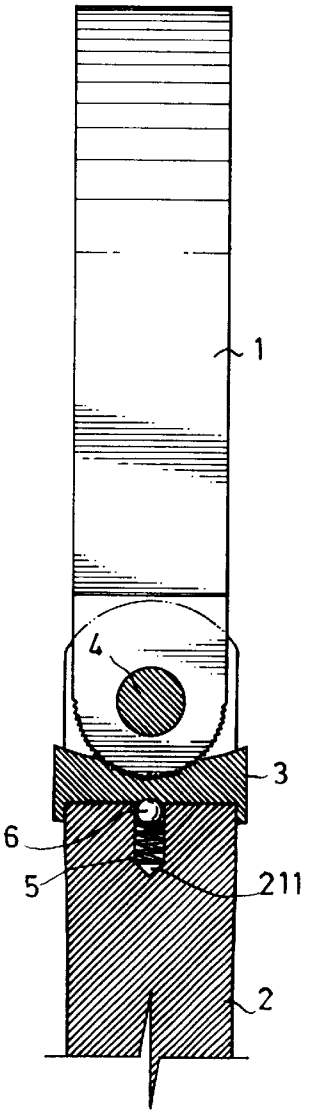
FIG. 9 is a side view of FIG. 8.
Figure 10:
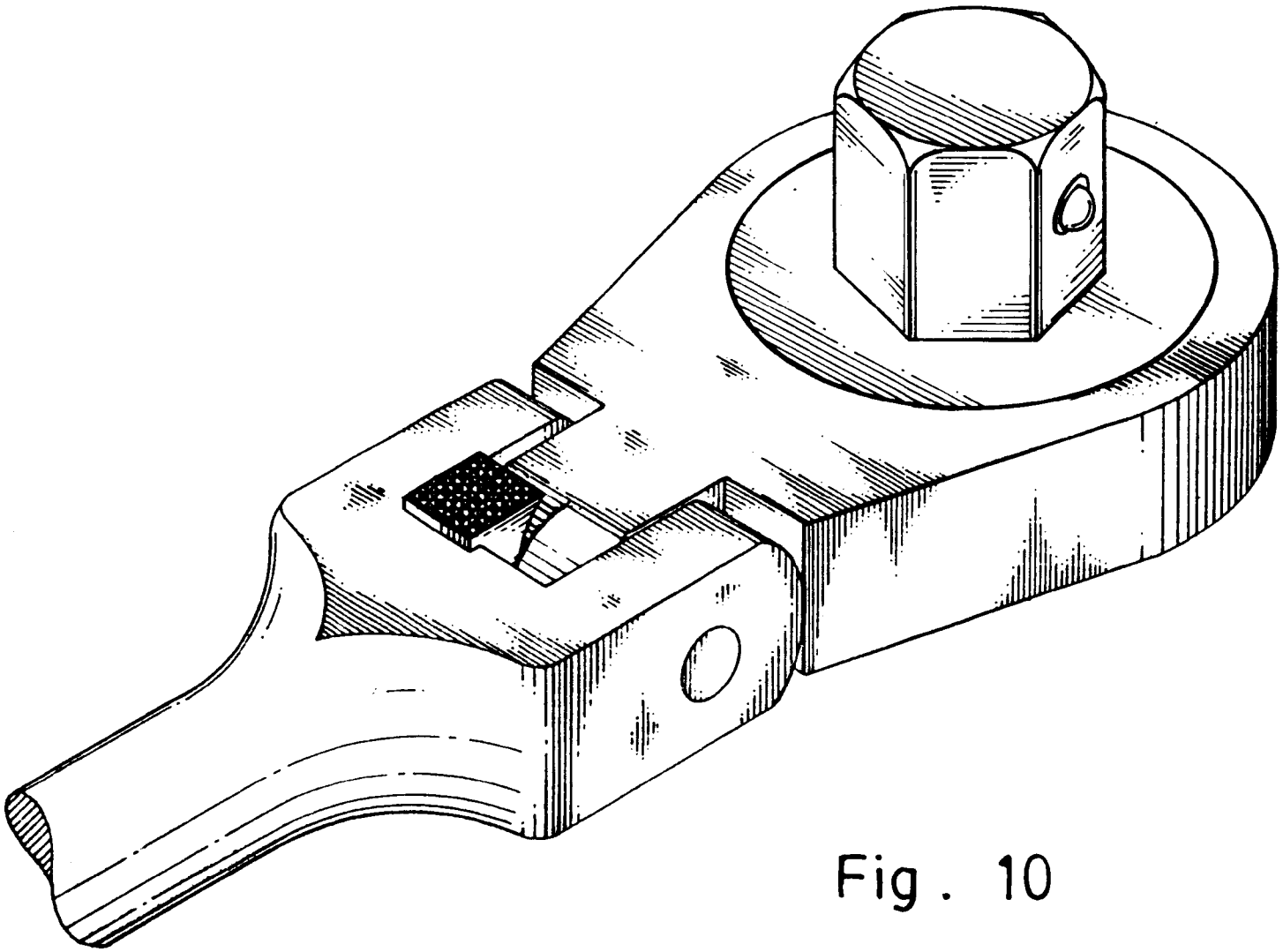
FIG. 10 shows an application example of the present invention.

Referring to Figures from 6 through 9, the stop member 3 can be moved along the front end of the handle 2 between the lugs 21 between the locking position where the toothed portion 31 of the stop member 3 is meshed with the toothed surface portion 121 of the coupling block 12 and the steel ball 6 is engaged into the locating hole 321 on the stop member 3, causing the wrench head 1 to be locked (see FIGS. 8 and 9), and the unlocking position where the stop member 3 is disengaged from the steel ball 6 and the toothed portion 31 of the stop member 3 is disposed in contact with the smoothly arched smooth surface portion 122, enabling the wrench head 1 to be turned about the pivot 4 to the desired angle relative to the handle 2 (see FIGS. 6 and 7).

While only one embodiment of the present invention has been shown and described, it will be understood that various modifications and changes could be made thereunto without departing from the spirit and scope of the invention disclosed.

What is claimed is:

1. An angle-adjustable wrench comprising a handle having a front end and two parallel lugs forwardly extended from the front end, a pivot connected between the lugs of said handle, and a wrench head turned about said pivot within 180° relative to said handle, wherein said wrench head comprises a retaining area and an adjustment area arranged in parallel and facing the front end of said handle between said lugs, and a stop member is coupled to said handle and moved along the front end of said handle between said lugs between a first position where said stop member is engaged with an arc-like, recessed, toothed portion thereof with said retaining area to lock said wrench head, and a second position where said stop member is disposed in contact with said adjustment area for enabling said wrench head to be turned about said pivot relative to said handle.

2. The angle-adjustable wrench of claim 1 wherein said retaining area of said wrench head is an arched, toothed surface, and said adjustment area of said wrench head is moothly arched smooth surface.

3. The angle-adjustable wrench of claim 1 wherein said handle comprises a blind hole on the front end thereof, a spring element installed in said blind hole, and a steel ball supported on said spring element and partially projecting out of said blind hole for engagement with said stop member when said stop member is moved to said first position.

4. The angle-adjustable wrench of claim 3 wherein said stop member comprises a locating hole on a back sidewall thereof for engagement with said steel ball.

* * * * *